United States Patent [19]

Wünsch et al.

[11] 4,368,784

[45] Jan. 18, 1983

[54] POWER SCREWDRIVER

[75] Inventors: Steffen Wünsch, Dettenhausen; Heinz Walz, Stuttgart, both of Fed. Rep. of Germany

[73] Assignee: Robert Bosch GmbH, Stuttgart, Fed. Rep. of Germany

[21] Appl. No.: 254,386

[22] Filed: Apr. 15, 1981

[30] Foreign Application Priority Data

Apr. 22, 1980 [DE] Fed. Rep. of Germany ..... 3015423

[51] Int. Cl.[3] ..... B25B 21/02

[52] U.S. Cl. ..... 173/12; 173/93.5; 192/34; 192/56 R; 81/464

[58] Field of Search ..... 173/12, 29, 93, 93.5, 173/94, 104; 81/463–467, 475, 57.14; 192/34, 56 R

[56] References Cited

U.S. PATENT DOCUMENTS

| | | | |
|---|---|---|---|
| 3,398,611 | 8/1968 | Hahner | 192/34 X |
| 3,616,883 | 11/1971 | Sindelar | 192/56 R |
| 3,710,873 | 1/1973 | Aller | 173/12 |
| 4,088,197 | 5/1978 | Roll et al. | 192/150 X |

*Primary Examiner*—Stephen G. Kunin
*Assistant Examiner*—Robert P. Olszewski
*Attorney, Agent, or Firm*—Michael J. Striker

[57] ABSTRACT

A power screwdriver has a drive motor and a tool holder arranged in a housing, a driving coupling including a driving coupling part driven by the motor and a driven coupling part, and a locking coupling arranged between the driving coupling and the tool holder, wherein the couplings are arranged so that when the tool holder is pressed against a screw the coupling parts of the driving coupling are connected with one another and torque from the motor is transmitted to the tool holder in a normal manner, when thereafter a limit torque is attained the locking coupling is overrun, the driving coupling part of the driving coupling is arrested, and the driven coupling part of the driving coupling is disconnected from the driving coupling part, and when the tool holder is pressed stronger against the screw which is difficult to screw in the driven coupling part displaces and follows the driving coupling part and is again connected with the latter so as to again provide for transmission of the torque from the motor to the tool holder.

22 Claims, 2 Drawing Figures

POWER SCREWDRIVER

BACKGROUND OF THE INVENTION

The present invention relates to a power screwdriver.

Power screwdrivers are known in the art. One of such power screwdrivers is disclosed for example in the German Offenlegungsschrift No. 2,505,393. This screwdriver has a coupling which operates in correspondence with the torque and actuates a locking device via various coupling parts when the limit torque is reached. Thereby, the energy supplied to the drive motor of the screwdriver is interrupted. This known screwdriver has an actuating device which maintains the interruption of the energy supply and switches on an additional coupling device for attainment of a higher torque. The above described screwdriver possesses the disadvantage that when the limit torque is exceeded, the motor must first be switched off and thereafter must be again switched on for transmission of a higher limit torque. The operator must actuate an additional handle which must be provided with all additional transmission means in the screwdriver.

SUMMARY OF THE INVENTION

Accordingly, it is an object of the present invention to provide a screwdriver which avoids the disadvantages of the prior art.

More particularly, it is an object of the present invention to provide a screwdriver in which a motor after attainment of the limit torque runs further and by merely stronger pressing of the tool against the screw can be adjusted for the transmission of the higher torque without switching means.

Still another feature of the present invention is to provide a power screwdriver which performs the above mentioned functions with the utilization of several coupling parts so that the construction of this screwdriver is very simple.

In keeping with these objects, and with others which will become apparent hereinafter, one feature of the present invention resides in a power screwdriver which has a driving coupling arranged between a drive motor and a tool holder and including a driving coupling part driven by the motor, and a locking coupling arranged in the housing between the driving coupling and the tool holder so that when the tool holder is pressed against a tool to be driven the coupling parts of the driving coupling are connected with one another and torque is transmitted to the tool holder, when thereafter a limit torque is attained the locking coupling is overrun and because of this the driving coupling part of the driving coupling is arrested in a position in which it is disconnected from the driven coupling part whereby the transmission of torque is interrupted, and when the tool holder is pressed more strongly against the screw the driven coupling part of the driving coupling displaces and follows the driving coupling part so as to be connected with the latter and again transmit torque from the motor to the tool holder.

In such a construction it is not necessary to switch off the motor after attainment of the limit torque, but it suffices to press the tool holder more strongly against the screw so as to continue the operation of the screwdriver.

In accordance with another advantageous feature of the present invention, the stronger pressing of the tool holder against the screw causes the transmission of a higher torque from the motor to the tool holder so that it becomes easier to unscrew screws which are screwed very tight in respective objects.

Still another advantageous feature of the present invention resides in the fact that the locking coupling and the separate driving coupling together form a disconnecting coupling, and the driven coupling part is displaceable together with and relative to the tool holder so as to form a part of both the locking coupling and the driving coupling.

The novel features which are considered characteristic for the present invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figures 1, 2:
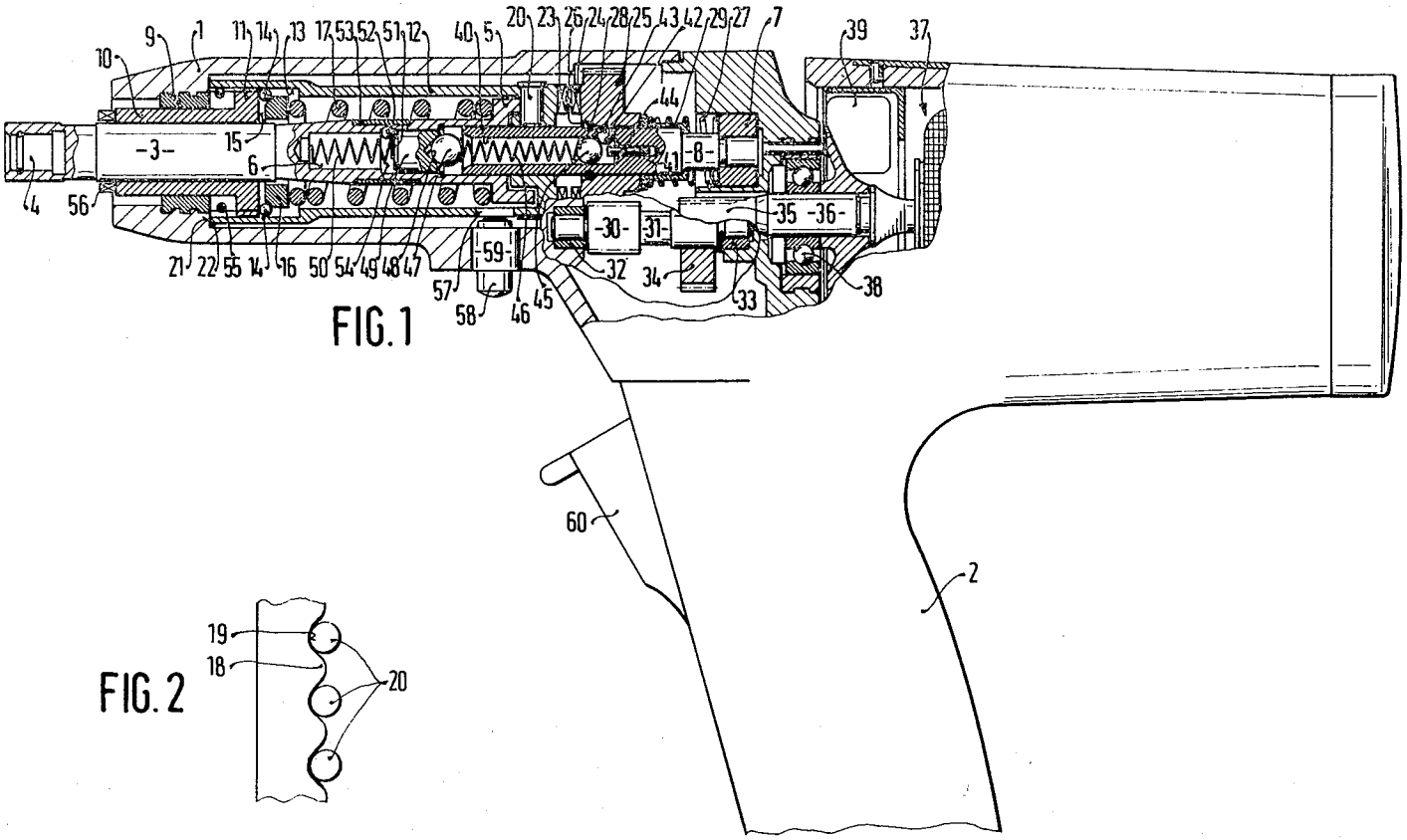
FIG. 1 is a view showing a power screwdriver in accordance with the present invention.
FIG. 2 is a view showing a part of a locking coupling of the power screwdriver of FIG. 1.

A power screwdriver in accordance with the present invention has a housing which is identified by reference numeral 1 and forms a handle 2. A tool holder 3 is mounted in the housing 1 rotatable and axially movable to a limited extent. The tool holder 3 has an end portion which extends axially outwardly beyond the housing 1 and is provided with a receiving opening 4 for a tool.

The tool holder 3 has another end portion which is located inside the housing and is provided with a collar 5 and a stepped hole 6. A shaft 8 is arranged in the housing in alignment with the tool holder 3 and partially engages in the hole 6. The shaft 8 is supported in a bearing bushing 7. The tool holder 3 is supported in the housing 1 with the aid of a sleeve bearing 9 and an adjusting sleeve 10 which is guided in the sleeve bearing 9.

The adjusting sleeve 9 has a collar 1 provided with an outer thread with which the adjusting sleeve 10 is screwed into a coupling sleeve 12. The coupling sleeve 12 has an inner thread in which the outer thread of the collar 11 of the adjusting sleeve 10 is screwed. The inner thread of the coupling sleeve 12 is interrupted by longitudinal grooves 13. The longitudinal grooves are so dimensioned that a ball 14 can partially engage in the same. Identical grooves 15 which, however, extend in a radial direction are provided in the end face of the collar 11 of the adjusting sleeve 10. The balls 14 also engage in the grooves 15.

The balls 14 are retained by a supporting ring 16. The latter is supported by the force of a spring 17 acting upon the tool spindle 3 and supporting at its rear end against the collar 5. The collar 5 has an end face provided with a plurality of projections 18 and grooves 19 forming a part of a locking coupling. Cylindrical rollers 20 arranged in radial openings of the coupling sleeve 12 cooperate with the projections 18 and grooves 19 of the collar 5 of the tool holder.

The coupling sleeve 12 surrounds both the adjusting sleeve 10 and the spring 17 and has an end face 21 which faces toward a tool and abuts against a respective face 22 of the housing 1. The coupling sleeve 12 has an end face which faces toward the hand of a user and forms teeth 23 of a driving coupling. The teeth 23 cooperate with teeth 24 provided on an oppositely located end face of a toothed gear 25. The toothed gear 25 is supported on the shaft 8 in rotatable and axially displaceable manner.

The toothed gear 25 has an axial hole provided with an annular recess 26 and is acted upon by a spring 27 so as to abut against a safety ring 28. A spring 27 is located in a hole in which the supporting bushing 7 is located and abuts against the latter. A sliding bushing 29 provides for guidance of the spring 27 at its end facing toward the toothed gear. The teeth of the toothed gear 25 engage with the teeth of a pinion 30 mounted on an intermediate shaft 31. The intermediate shaft 31 is supported in bearings 32 and 33 which are fixedly mounted in the housing and in addition carry a tooth gear 34. The toothed gear 34 engages with a pinion 35 formed on a motor shaft 36. The motor shaft 36 of a motor 37 is supported in a ball bearing 35 and carries a fan 39.

The shaft 8 has a longitudinal opening 40 which opens toward the tool holder 3 and makes an extension of a hole 41 of a smaller diameter. A radial opening 42 is provided at the end of the longitudinal opening 40. The radial opening 42 receives an arresting ball 43. A pin 44 arranged in the hole 41 is so dimensioned that it prevents the dropping of the arresting ball 43 into the longitudinal opening 40. The pin 44 simultaneously serves as an abutment for a ball 45 which is guided in the longitudinal opening 40. The ball 45 is acted upon by a spring 46 which is also located in the longitudinal opening 40 and abuts with its other end against a further ball 47.

The ball 47 has a greater diameter than the diameter of the longitudinal opening 40 which is beveled at its outlet end and forms a seat for the ball 47. The ball 47 rests in turn in a depression 48 of a pressing member 49.

The pressing member 49 is guided in the stepped hole 6 and is acted upon by a spring 50 which in turn is located in the hole 6. The pressing member 49 has a face 51 which contacts an arresting ball 52 arranged in a radial opening of the tool spindle 33 and pressed radially inwardly by a ring-shaped flat spring 53. When the pressing member 49 displaces the arresting ball 52 radially outwardly, the pressing member 49 during its further movement can abut against an end stop which is formed as a step 54 in the hole 6.

A safety ring 55 in the coupling sleeve 12 prevents unscrewing of the adjusting sleeve 10 from the coupling sleeve 12 during the mounting. The adjusting sleeve 10 has an end portion which extends axially outwardly beyond the housing 1 toward a tool and is provided with engaging faces 56 to be engaged by a wrench. The coupling sleeve 12 has a radial opening 57, and a locking pin 58 with a guiding sleeve 59 are arranged in the housing 1 and associated with this opening. A handle 60 serves for switching on and switching off of the power screwdriver.

The above described power screwdriver operates in the following manner:

When the screwdriver is applied against a screw to be screwed and the tool holder 3 is pressed into the housing 1, the teeth 23 and the teeth 24 of the driving coupling 12, 25 engage each other. After this the handle 30 is actuated and the motor 37 is turned on. It is also possible to turn on first the motor 37 and after this to apply the screwdriver against a screw. The torque of the motor 37 is transmitted via the motor shaft 37, the pinion 35, the tooth gear 34, the intermediate shaft 31, and the pinion 30 to the toothed gear 25. The coupling sleeve 12 is driven from the toothed gear 25 via the driving coupling 12, 25. The rotation of the coupling sleeve 12 is transmitted via the locking coupling 12, 20, 18, 19, 5 to the tool holder 3.

The pressure with which the cover 5 with its projections 18 and grooves 19 is pressed against the cylindrical rollers 20, is determined by the respective tensioning of the spring 17 with the adjusting sleeve 10. Thereby the transmission torque can be varied within certain limits. For adjusting the tension of the spring 17, the locking pin 58 is pressed into the radial opening 57 of the coupling sleeve 12. Then the adjusting sleeve 10 is rotated by the engaging faces 56 relative to the thus locked coupling sleeve 12. Thereby the adjusting sleeve 10 is screwed either further into the coupling sleeve 12 or further out of the latter. The ball 14 can be pressed out of its arresting position in the longitudinal groove 13 and the grooves 15 to the next arresting position. Thereby an unintentional adjustment of the adjusting sleeve 10 in the coupling sleeve 12 is prevented. When the desired transmission torque of the locking coupling 12, 20, 5 is determined, the screw can be screwed in in a normal way. When the screw is tightly screwed in, the locking coupling responds to this position and the coupling sleeve 12 is displaced from the projections 8 through its cylindrical rolls 20 to the right in FIG. 5. Thereby the toothed gear 25 displaces rightwardly. When the ring-shaped recess 26 is moved to the arresting ball 43, the latter engages into the ring-shaped recess 26 under the action of the spring 46 which is driven via the ball 45. Thereby the toothed gear 25 is firmly retained against the action of the spring 27 in this position. When the cylindrical rollers 20 enter the next groove 19 of the locking coupling, the teeth 23 disengage from the teeth 24, and the toothed gear 25 does not follow the rearward movement of the coupling sleeve 12. As a result of this, the transmission of movement from the toothed gear 25 to the tool holder 3 is interrupted. When now the screwdriver is removed from the tightly screwed screw, the spring 46 releases and displaces the tool holder 3 with the coupling sleeve 12 to the left to such an extent until the coupling sleeve 12 again abuts against the end face 21 of the housing 1. The tension of the spring 46 is now not sufficient to retain the arresting ball 43 against the action of the spring 27 in its arresting position. The arresting ball 43 is pressed inwardly, and the toothed gear 25 is displaced to the left until abutment against the safety ring 25. Thereby, the screwdriver reaches its initial position for screwing of a new screw.

When a new screw is difficult to screw so that it requires an increased torque, the locking coupling provides for respective reaction. The coupling connection in the driving coupling is turned off. In this position, the ball 47 is received in the depression of the longitudinal opening 40 of the shaft 8 and cannot further resiliently deflect. The increased pressure on the tool holder 3 acts in such a manner that it overcomes the arresting action of the arresting ball 52 and displaces to the right to such a distance until the step 54 in the stepped hole 6 of the tool holder 3 abuts against the pressing member 49. In this movement the coupling sleeve 12 follows the toothed gear 25 to such an extent that its teeth 23 again engage with the teeth 24 of the toothed gear 25. This coupling connection cannot be now automatically released. The coupling sleeve 12 and the toothed gear 25 are rhythmically reciprocated during the alternate running of the cylindrical rollers 20 on the projections 18 and in the grooves 19. Thereby the tool holder 3 is subjected to rotary impacts from the coupling sleeve 12. The torque is increased in this case in pulse-like manner and overcomes the resistance to screwing-in of the screw so that the latter can finally be screwed in tightly. When the screwdriver is removed from the screw, the spring 50 drives the pressing member 49 to the right in FIG. 1 and the arresting ball 52 again engages behind the face 51 of the pressing member 49. The tool holder 3 and the coupling sleeve 12 therewith are displaced by the spring 46 to the left until the coupling sleeve 12 abuts against the end face 21 of the housing. The toothed gear 25 again assumes its initial position in the above described manner under the action of the spring 27. The ball 47 at the end of this movement is displaced from the shaft 8 by a distance which corresponds to the stroke of disconnection between the teeth 23 and 24 of the driving sleeve 12 and 25. The power screwdriver is again ready for a new screwing step.

The arresting ball 52 in cooperation with the face 51 and the force of the ring-shaped flat spring 53 form a readily recognizable pressure point for the normal disconnecting position of the driving coupling 12, 25. This facilitates the manipulation of the inventive screwdriver. For increasing the predetermined torque, the operator is not required to actuate an additional handle, but instead it suffices to overcome the above mentioned pressure point.

The different working regimes can be easily recognized by the difference between the continuous screwing in normal region and the impact-like screwing in an overloading situation.

It will be understood that each of the elements described above, or two or more together, may also find a useful application in other types of constructions differing from the types described above.

While the invention has been illustrated and described as embodied in a power screwdriver, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A power screwdriver, comprising a housing; a drive motor; a tool holder arranged in said housing to support a tool and having an axis; a driving coupling arranged in said housing between said drive motor and said tool holder and including a driving coupling part driven by said motor, and a driven coupling part arranged to be connected with and disconnected from said driving part; and a locking coupling arranged in said housing between said driving coupling and said tool holder, said couplings being arranged so that when said tool holder is pressed against a screw to be driven and displaces inwardly of said housing, said coupling parts of said driving coupling are connected with one another and torque from said motor is transmitted to said tool holder, when thereafter a limit torque is attained, said locking coupling is overrun and because of this said driving coupling part of said driving coupling is arrested in a position in which it is disconnected from said driven coupling part and the transmission of torque from said motor to said tool holder is interrupted, and when said tool holder is pressed stronger against the screw and further displaces inwardly of said housing, said driven coupling part of said driving coupling displaces and follows said driving coupling part so as to be connected with the latter and to again provide for transmission of the torque from said motor to said tool holder.

2. A power screwdriver as defined in claim 1; and further comprising means for increasing the torque transmitted from the motor to said tool holder, arranged to operate in response to the stronger pressing of said tool holder against the screw.

3. A power screwdriver as defined in claim 1; and further comprising pressure point forming means and an abutment forming means arranged so that, when said tool holder is pressed against the tool and displaces inwardly of said housing it reaches a position which is marked by said pressure point and in which the torque transmission can be interrupted, and when said tool holder is pressed stronger against the screw and displaces further inwardly of said housing, it overruns said pressure point and reaches a further position which is marked by said abutment and in which the interruption of torque transmission is avoided.

4. A power screwdriver as defined in claim 1, wherein said locking coupling and said driving coupling which is separate from said locking coupling together form a disconnecting coupling, said driven coupling part being displaceable together with and relative to said tool holder and forming a part of both said locking coupling and said driving coupling.

5. A power screwdriver as defined in claim 4; and further comprising means for arresting said driving coupling part of said driving coupling, said driving coupling part of said driving coupling being axially displaceable relative to said tool holder so that when the limit torque is attained on said tool holder and thereby on said driving coupling part connected therewith, said driving coupling part is displaced to the position in which it is axially arrested by said arresting means, whereas said driven part overruns said locking coupling and because of this departs from said driving part so as to be disconnected from the latter.

6. A power screwdriver as defined in claim 5, wherein said axially arrestable driving coupling part of said driving coupling is formed as a motor-driven toothed gear.

7. A power screwdriver as defined in claim 6; and further comprising a shaft arranged in said housing in alignment with said tool holder and supporting said toothed gear so that the latter is rotatable and axially displaceable relative to said shaft.

8. A power screwdriver as defined in claim 6, wherein said tool holder has an axial opening, said shaft which supports said toothed gear also supporting said driven coupling part, said shaft having a free end engaging in said axial opening of said tool holder and thereby also supporting the latter.

9. A power screwdriver as defined in claim 6, wherein said tool holder has an end face facing inwardly of said housing and provided with a plurality of projections and grooves forming one part of said locking coupling, said driven coupling part being formed as a coupling sleeve which partially surrounds said tool holder and said shaft and is provided with rollers engageable with said projections and grooves and forming the other part of said locking coupling.

10. A power screwdriver as defined in claim 9, wherein said driven coupling part formed as a coupling sleeve has a plurality of openings, said rollers being cylindrical and received in said opening.

11. A power screwdriver as defined in claim 1, wherein said tool holder has an inner end facing axially inwardly of said housing and provided with a collar, said driven coupling part having an outer end facing axially outwardly of said housing toward a tool and provided with an adjustment sleeve screwed into said outer end; and further comprising a spring arranged between said collar of said tool holder and said adjusting sleeve of said driven coupling part so that the tension of said spring can be adjusted by screwing of said adjusting sleeve relative to said driven coupling part.

12. A power screwdriver as defined in claim 7; and further comprising a first spring urging said driving coupling part formed as the toothed gear toward engagement with said driven coupling part, said toothed gear being provided with an annular recess and said shaft being provided with a radial opening, said arresting means including an arresting ball guided in said radial opening of said shaft and retained in said radial opening when said first spring urges said driving coupling part toward the engagement, and a second spring urging said arresting ball radially outwardly of said radial opening of said shaft so as to arrest said toothed gear.

13. A power screwdriver as defined in claim 12, wherein said second spring is tensioned so that only when said tool holder is displaced inwardly, said second spring is tensioned stronger and prevents displacement of said arresting ball back into said radial opening under the action of said first spring urging said driving part toward the engagement.

14. A power screwdriver as defined in claim 12, wherein said shaft is provided with a longitudinal opening; and further comprising a second ball located between said arresting ball and said second spring, said second spring being arranged in said longitudinal opening of said shaft and abutting against said tool holder.

15. A power screwdriver as defined in claim 13; and further comprising an additional ball cooperating with said second spring, a thrust member cooperating with said additional ball, and an additional spring located between said thrust member and said tool holder so that said second spring abuts against said tool holder via said additional ball, said thrust member and said additional spring.

16. A power screwdriver as defined in claim 15, wherein said additional ball has a diameter exceeding that of said longitudinal opening of said shaft and can thereby directly abut against said shaft, so that said thrust member which is spring biased from said shaft can be brought into an abutting position with said additional ball when said additional ball directly abuts against said shaft.

17. A power screwdriver as defined in claim 16, wherein said tool holder has an axial opening in which said thrust member is guided; and further comprising, a step provided in said axial opening so that said thrust member can move to abutment against said step, and a further arresting ball provided in said axial opening and arranged so that it terminates its arresting action when said thrust member abuts via said additional ball against said shaft as a result of said tool holder and said driven coupling part being pressed stronger against the screw.

18. A power screwdriver as defined in claim 17, wherein said driving coupling has a predetermined stroke of disconnection of its coupling parts, said thrust member and said additional ball being displaceable between a first position in which said tool holder does not displace inwardly of said housing and a second position in which said thrust member abuts via said additional ball against said shaft, the stroke of displacement between said first and second positions corresponding to said stroke of disconnection of said driving coupling.

19. A power screwdriver as defined in claim 17, wherein said driven coupling part has a predetermined stroke of displacement to follow said driving part so as to be connected with the latter, said thrust member being displaceable between one position in which it abuts against said additional arresting ball and another position in which it abuts against said step, the stroke of displacement between said one and other positions corresponding to said stroke of displacement of said driven coupling part to follow said driving coupling part.

20. A power screwdriver as defined in claim 11; and further comprising means for preventing turning of said driven coupling part during screwing of said adjusting sleeve for adjusting purposes.

21. A power screwdriver as defined in claim 21, wherein said driven coupling part has a radial opening, said preventing means including an outwardly actuated locking bolt arranged to be inserted into said radial opening of said driven coupling part.

22. A power screwdriver as defined in claim 20, wherein said adjusting sleeve has a portion extending outwardly of said housing toward a tool and arranged to be engaged by a wrench.

* * * * *